United States Patent [19]

McAlpine

[11] Patent Number: 4,872,565

[45] Date of Patent: Oct. 10, 1989

[54] APPARATUS AND METHOD FOR CLEARING DEBRIS FROM CUT TREES

[76] Inventor: Don J. McAlpine, R.R. 2, Mediapolis, Iowa 52637

[21] Appl. No.: 155,547

[22] Filed: Feb. 12, 1988

[51] Int. Cl.[4] ..... B07C 9/00

[52] U.S. Cl. ..... 209/699; 29/403.1; 56/328.1; 144/2 R; 209/606

[58] Field of Search ..... 29/403.1; 56/328.1; 366/114; 209/699, 606; 144/2 R

[56] References Cited

U.S. PATENT DOCUMENTS

| | | | |
|---|---|---|---|
| 2,522,906 | 9/1950 | Smith | 41/15 |
| 2,656,669 | 10/1953 | Avasino | 56/328 |
| 3,206,919 | 9/1965 | Read | 56/328 |
| 3,861,061 | 1/1975 | Ross | 34/103 |
| 4,254,608 | 3/1981 | Friday | 56/328 |
| 4,409,782 | 10/1983 | Westergaard | 56/328 |
| 4,463,602 | 8/1984 | Stoddard | 73/153 |

*Primary Examiner*—W. Donald Bray

*Attorney, Agent, or Firm*—Richards, Harris, Medlock & Andrews

[57] ABSTRACT

A Christmas tree shaker including a base with a horizontal turntable mounted rotatably thereon on a motor driven shaft. A tree trunk receiving receptacle is mounted on the turntable for limited relative rotation with respect thereto. The receptacle is offset from the turntable axis of rotation. A stabilizer link between the base and receptacle limits the amount of relative rotation between the receptacle and turntable as the motor driven shaft rotates the turntable causing the receptacle to travel rapidly in a tight circle.

13 Claims, 1 Drawing Sheet

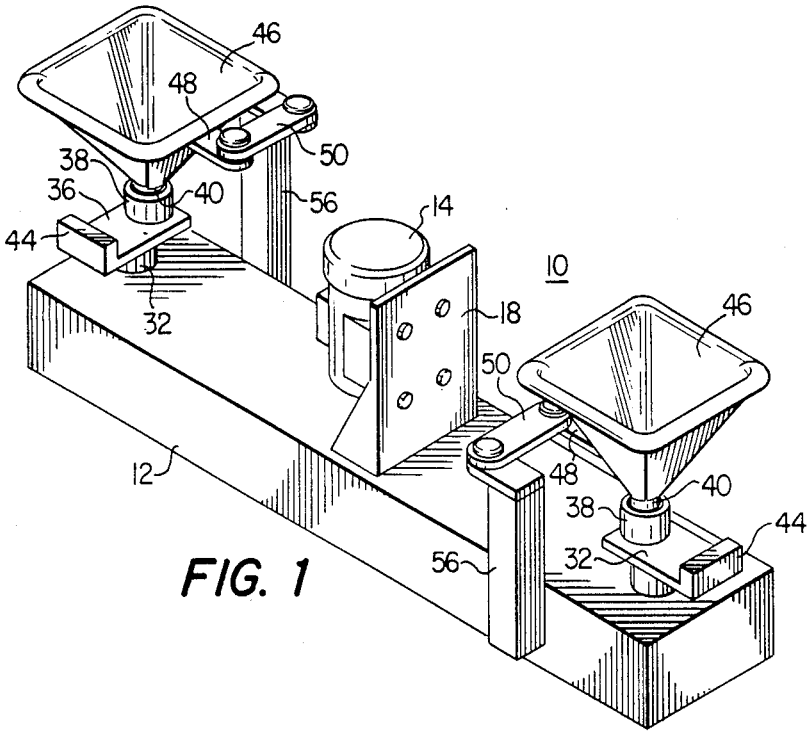
FIG. 1
FIG. 3
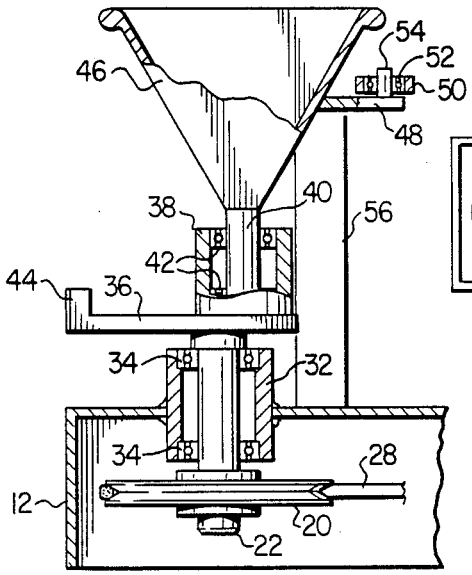
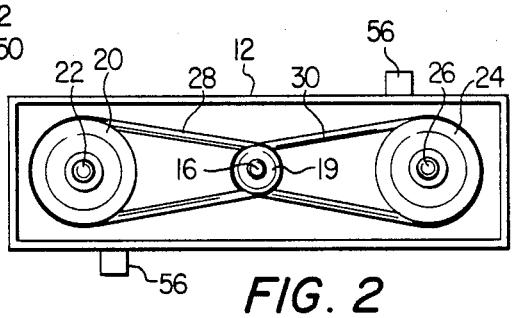
FIG. 2

APPARATUS AND METHOD FOR CLEARING DEBRIS FROM CUT TREES

TECHNICAL FIELD

This invention relates to an apparatus and method for removing accumulated masses of fallen dead needles and other debris from the interior of cut evergreen trees. In particular, it contemplates an efficient and economical system of preparation for sale of cut Christmas trees of types in which the tree branches tend to accumulate clumps of fallen needles.

BACKGROUND OF THE INVENTION

In the cutting and shipment of evergreen trees for the Christmas tree trade, a nagging problem has persisted involving the unwated and unsightly accumulation of dead needles within the interior branches of the trees. This has been a particular problem with those tree varieties with very thick bushy growth such as, for example, the Virginia pine.

Manual clearing of the thick clumps of debris is time consuming and laobrious, and thus expensive. While there have been machines offered to clear trees by placing them horizontally on a vibrating platform or cradle, they have not been particularly successful. The apparatus and method of this invention is believed to be the most efficient an economical approach to the problem heretofore devised.

SUMMARY OF THE INVENTION

In accordance with the invention, there is provided a tree shaker including a base, a vertical shaft journaled for rotation with respect to the base and carrying a horizontal turntable means. A receptacle shaped for receiving the cut end of a tree trunk oriented vertically is mounted on the table for relative rotation with respect to the turntable, and is horizontally offset from the vertical shaft. Means are provided for rotating the shaft, whereby the cut end of the tree is rotated rapidly in a tight circle by rotation of the shaft to clear out accumulated needles or other debris from the interior branches of the tree.

In a further aspect, the shaker includes a stabilizer link which is pivotally connected at one end to the base, and is pivotally connected at its other end to the tree receptacle so that relative rotation of the receptacle with respect to the turntable itself is limited. The driving means for the shaft may include a motor means connected by a belt to a pulley mounted on the lower end of the shaft. Advantageously, the shaker may include two similarly configured shaft, turntable and tree trunk receiving receptacles simultaneously driven by the motor means, so that two trees may simultaneously be cleared by opeation of the device.

The novel method of this invention includes the placement of the cut end of the tree vertically in a receptacle mounted on a rotatable horizontal turntable, followed by rapid rotation of the turntable in a horizontal plane so that the receptacle travels in a circle.

BRIEF DESCRIPTION OF THE DRAWINGS

For a more complete understanding of the present invention and for further advantages thereof, reference is now made to the following Description taken in conjunction with the accompanying Drawing which is a block diagram of the present invention.

FIG. 1 is a perspective view of an embodiment of the invention for simultaneously clearing the debris from two cut trees;

FIG. 2 is a bottom view of the device shown in FIG. 1; and

FIG. 3 is a partial cross section illustrating the mechanism for shaking one of the tree in the embodiment shown in FIG. 1.

DETAILED DESCRIPTION

A preferred embodiment of a tree shaker of this invention is designated as reference numeral 10. Shaker 10 includes an elongate base 12 which serves to mount the operational components of the system. Centrally mounted on base 12 is a vertically oriented electric motor 14 which serves to rotate motor shaft 16. The motor is held in position on the base by securement to motor mounting plate 18 upstanding from base 12. The lower end of motor shaft 16, below base 12, carries a pair of spaced identical pulleys 19, only the lower of which can actually be seen in FIG. 2. Driving pulleys 18 are mounted to transmit power to driven pulley 20 mounted on shaking arbor 22, and to driven pulley 24 mounted on shaking arbor 26, by means of belts 28 and 30, respectively. The shaker components connected to shaking arbors 22 and 26 may be identical, and are given the same reference numerals in the drawings. Only one is illustrated in detail in FIG. 3. As can be seen, the major driving elements are safely concealed out of harm's way within enclosed base 12.

Shaking arbor 22 is carried rotatably within sleeve 32 on base 12 by means of bearings 34. A horizontal turntable 36 is carried on arbor 22 above base 12 for rotation with the arbor. Vertical receptacle mounting sleeve 38 is carried on the upper side of turntable 36 offset from the axis of arbor 22. A receptacle base 40 is journaled for relative rotation with respect to sleeve 38 by bearings 42. The turntable 36 is provided with upstanding counterweight leg 44 to balance rotational forces.

The upper end of receptacle base 40 carries a tree receiving receptacle 46. Receptacle 46 is an upwardly opening cup which is formed by downwardly converging trapezoidal sides to accommodate various sizes of cut tree trunks. Preferably, the offset of receptacle base 40 with respect to the shaking arbor 22 is on the order of one half to one inch, so that receptacle 46 moves in a tight circle as turntable 36 is rotated.

Receptacle 46 includes a horizontally extending ear 48. Stabilizer link 50 is pivotally pinned at one end thereof to ear 48 by means of bearings 52 and pin 54. At its other end, stabilizer link 50 is pivotally pinned to an upstanding anchor 56 formed on base 12. Thus, while receptacle 46 may rotate with respect to the turntable 36, the relative rotation is limited by the constraining force of the stabilizing link 50.

In operation, the shaker 10 may be operated to clear the debris from two cut trees simultaneously. The trees are manually held vertically with their cut ends received in receptacles 46. The motor 14 is activated to drive arbors 20 and 24. The receptacles 46 rotate rapidly carried by turntables 36 in tight circles, while being restrained from excessive rotation with respect to turntable 36 by stabilizer links 50. The speed of driving should be sufficient to clear the tree, while not causing undue damage to the tree itself. Rotation in a circle of 1 to 1½ inch diameter has been effective for many tree varieties in the speed range of approximately 500 to 850 rpm. A speed of 685 rpm has proven to be satisfactory for a single speed device.

While the preferred embodiment is illustrated with electric motor 14 as the driving means, other means for driving the shaking arbors may be selected. For example, the device may be supplied without power, but with suitable hookup for external power as by a tractor takeoff. It may be provided with other driving means such as gasoline or diesel powered engines.

It may be appreciated from the foregoing description that the apparatus and method of this invention represents an economical and efficient answer to the problems associated with the preparation of christmas trees for marketing.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A tree shaker comprising:

(a) a base;

(b) a vertical shaft journalled for rotation with respect to the base;

(c) horizontal turntable means carried by the shaft;

(d) means for rotating the shaft; and (e) a receptacle shaped for receiving the cut end of a tree trunk, mounted on the turntable for relative rotation with respect to the turntable, and horizontally offset from the shaft.

2. The tree shaker of claim 1, further comprising a stabilizer link pivotally connected at one end to the base, and pivotally connected at its other end to the receptacle to limit the rotation of the receptacle with respect to the turntable.

3. The tree shaker of claim 1, wherein the inside of the receptacle is formed by downwardly converging trapezoidal surfaces.

4. The tree shaker of claim 1, wherein the means for rotating the shaft includes a motor means connected by a belt to a pulley mounted on the lower end of the shaft.

5. The tree shaker of claim 4, wherein the base carries at least one additional similarly configured shaft, turntable and tree trunk receiving receptacle, which are simultaneously driven by the motor means.

6. A tree shaker comprising:

(a) a base;

(b) a vertical shaft journalled for rotation with respect to the base;

(c) horizontal turntable means carried by the shaft;

(d) means for rotating the shaft;

(e) a receptacle shaped for receiving the cut end of a tree trunk, mounted on the turntable for relative rotation with respect to the turntable, and horizontally offset from the shaft; and (f) means for limiting rotation of the tree trunk receiving receptacle with respect to the turntable means.

7. The tree shaker of claim 6, wherein the receptacle includes a cup and rigidly secured stabilizer arm, and the means for limiting rotation of the receptacle comprises a stabilizer link pivotally secured at one end to the base and at the other end to the stabilizer arm.

8. The tree shaker of claim 6, wherein the inside of the receptacle is formed by downwardly converging trapezoidal surfaces.

9. The tree shaker of claim 6, wherein the means for rotating the shaft includes a motor means connected by a belt to a pulley mounted on the lower end of the shaft.

10. The tree shaker of claim 6, wherein the base carries at least one additional similarly configured shaft, turntable and tree trunk receiving receptacle, which are simultaneously driven by the motor means.

11. A method of shaking dead needles and debris from a cut evergreen tree comprising:

(a) placing the cut end of the tree vertically in a receptacle mounted on a rotatable horizontal turntable; and (b) rapidly rotating the turntable in a horizontal plane so that the receptacle travels in a circle.

12. The method of claim 11, further comprising the step, simultaneously with step (b), of permitting the receptacle to rotate within limits with respect to the turntable.

13. The method of claim 11, wherein the circle travelled by the receptacle has a diameter less than about 2 inches.

* * * * *